US006135927A

United States Patent [19]

Lo

[11] Patent Number: 6,135,927

[45] Date of Patent: Oct. 24, 2000

[54] FOLDABLE EXERCISER

[76] Inventor: Kun-Chuan Lo, No. 3, Ching-Cheng-Ssu St., Taichung, Taiwan

[21] Appl. No.: 09/430,283

[22] Filed: Oct. 29, 1999

[51] Int. Cl.[7] ..... A63B 22/06

[52] U.S. Cl. ..... 482/57; 482/51; 482/52; 482/908

[58] Field of Search ..... 482/51, 52, 53, 482/70, 908, 5

[56] References Cited

U.S. PATENT DOCUMENTS

| | | | |
|---|---|---|---|
| 5,423,729 | 6/1995 | Eschenbach | 482/70 |
| 5,989,159 | 11/1999 | Chen et al. | 482/52 |
| 6,019,710 | 2/2000 | Dalebout et al. | 482/70 |
| 6,030,319 | 2/2000 | Wu | 482/51 |

*Primary Examiner*—Stephen R. Crow
*Assistant Examiner*—Tam Nguyen
*Attorney, Agent, or Firm*—Trop, Pruner & Hu, P.C.

[57] ABSTRACT

A foldable exerciser includes a base member, an upright post, a pair of rail members, and a pair of pedal rods. The base member has a main shaft, and front and rear bars connected transversely to the main shaft. The upright post is connected to the front bar of the base member. The rail members are connected slidably and respectively to the opposed ends of the rear bar. Each of the rail members has front and rear ends, and is disposed perpendicularly to the rear bar on either side of the base member. The rail members are movable between a retracted position and an extended position. Each of the pedal rods is disposed on either side of the base member and has front and rear sections. The rear sections are foldable forwardly relative to the front sections of the pedal rods. The upright post has a lower tube and an upper tube that is foldable downwardly relative to the lower tube.

5 Claims, 9 Drawing Sheets

FOLDABLE EXERCISER

BACKGROUND OF THE INVENTION

1. Field of the Invention

This invention relates to an exerciser, more particularly to a foldable exerciser.

2. Description of the Related Art

Referring to FIG. 1, a conventional exerciser is shown to comprise an elongated base member 1, an upright post 2 connected to a front end of the base member 1, a transmission wheel 3 mounted rotatably on the base member 1, and a resistance device associated with the transmission wheel 3 for providing resistance against rotation of the transmission wheel 3. Two parallel rail members 5 extend integrally from a rear end of the base member 1. A pair of pedal rods 6 are disposed respectively on opposite sides of the base member 1. Each of the pedal rods 6 is connected to the transmission wheel 3 by a crank arm 7 in order to drive the transmission wheel 3. In this way, the user can exercise by pedaling the pedal rods 6. Although the conventional exerciser can be employed to exercise one's legs, it is bulky and is difficult to transport and store.

SUMMARY OF THE INVENTION

The object of the present invention is to provide a foldable exerciser that is foldable to form a compact structure and that is easy to transport and store.

According to the present invention, the foldable exerciser comprises a base member, an upright post, a pair of rail members, and a pair of pedal rods. The base member has a main shaft, front and rear bars connected transversely to two ends of the main shaft, a transmission wheel mounted rotatably on the main shaft, and a resistance device associated with the transmission wheel for providing resistance against rotation of the transmission wheel. The upright post is connected to the front bar of the base member. The rail members are connected slidably and respectively to two opposed ends of the rear bar. Each of the rail members has front and rear ends, and is disposed perpendicularly to the rear bar on either side of the base member. The rail members are movable between a retracted position in which the front ends of the rail members are proximate to the front bar while the rear ends of the rail members are proximate to the rear bar, and an extended position in which the front ends of the rail members are proximate to the rear bar while the rear ends of the rail members are distal from the rear bar. Each of the pedal rods is disposed on either side of the main shaft of the base member and has front and rear sections. The front section of each of the pedal rods has a front end, a rear end, and a crank arm interconnecting the front end thereof and the transmission wheel. The rear section of each of the pedal rods has a front end connected pivotally to the rear end of the front section of a corresponding one of the pedal rods so that the rear sections of the pedal rods are foldable forwardly relative to the front sections of the pedal rods, and a rear end having a roller that is connected thereto and that is disposed on a corresponding one of the rail members when the rail members are in the extended position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
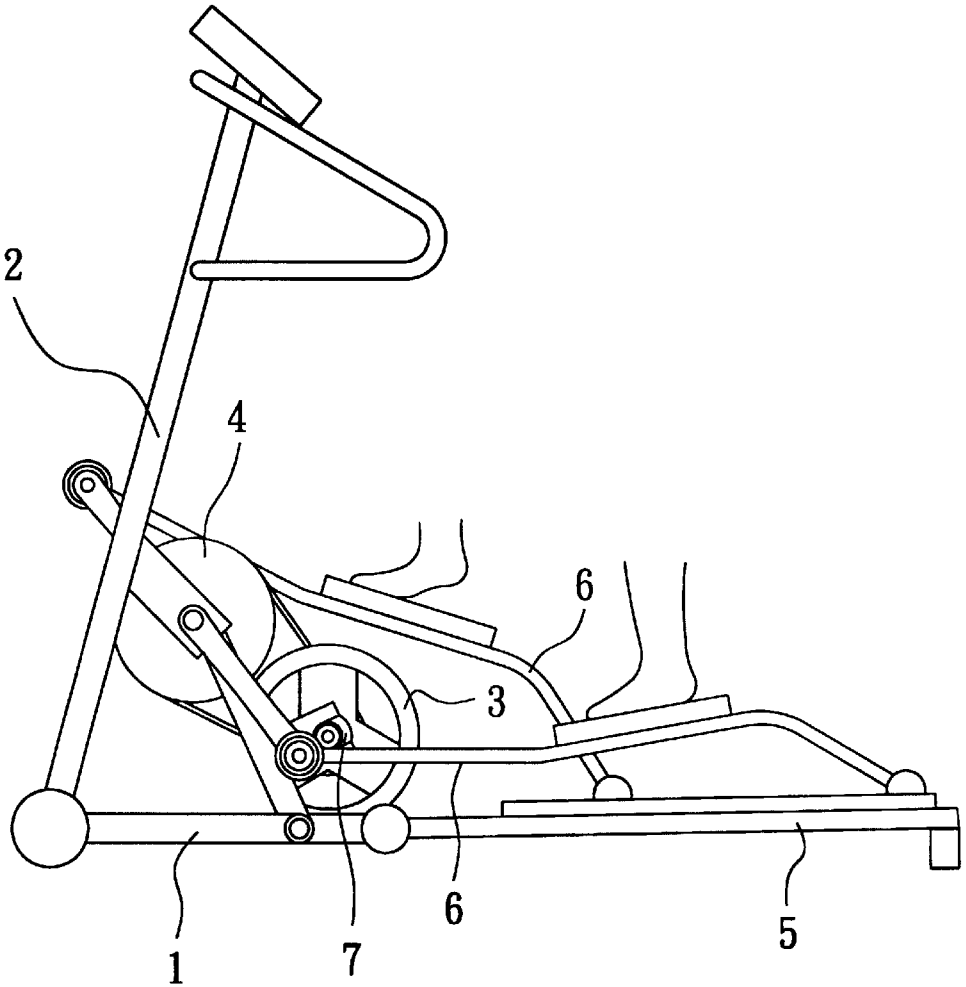
FIG. 1 PRIOR ART
FIG. 1 is a side view of a conventional exerciser.
Figure 2:
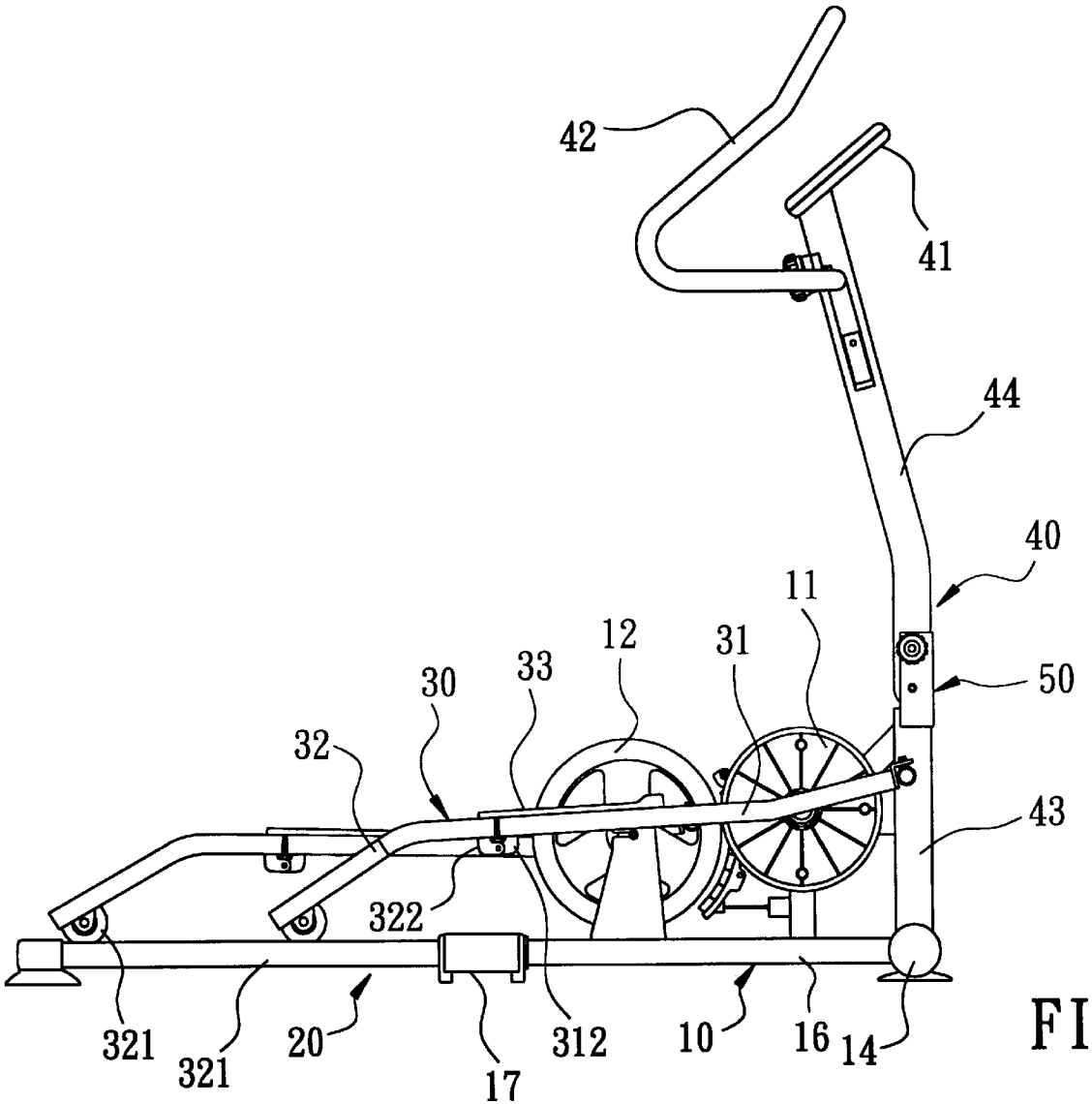
FIG. 2 is a side view of a preferred embodiment of a foldable exerciser according to the present invention.

Referring to FIG. 2, a preferred embodiment of a foldable exerciser according to the present invention is shown to comprise a base member 10, a pair of rail members 20, a pair of pedal rods 30, and an upright post 40.

Figure 3:
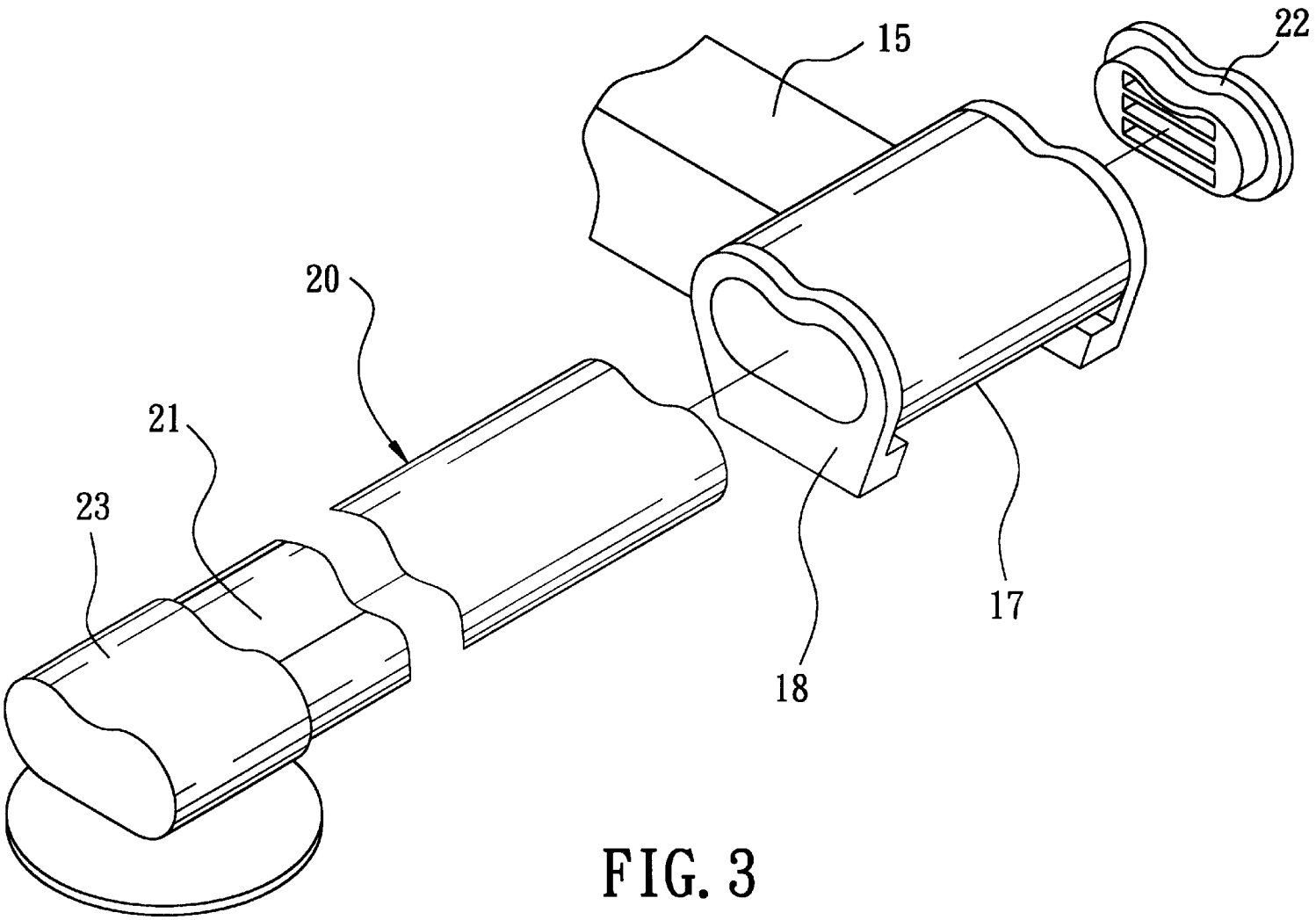
FIG. 3 is a fragmentary exploded view of a rail member of the preferred embodiment of the foldable exerciser according to the present invention.
Figure 6:
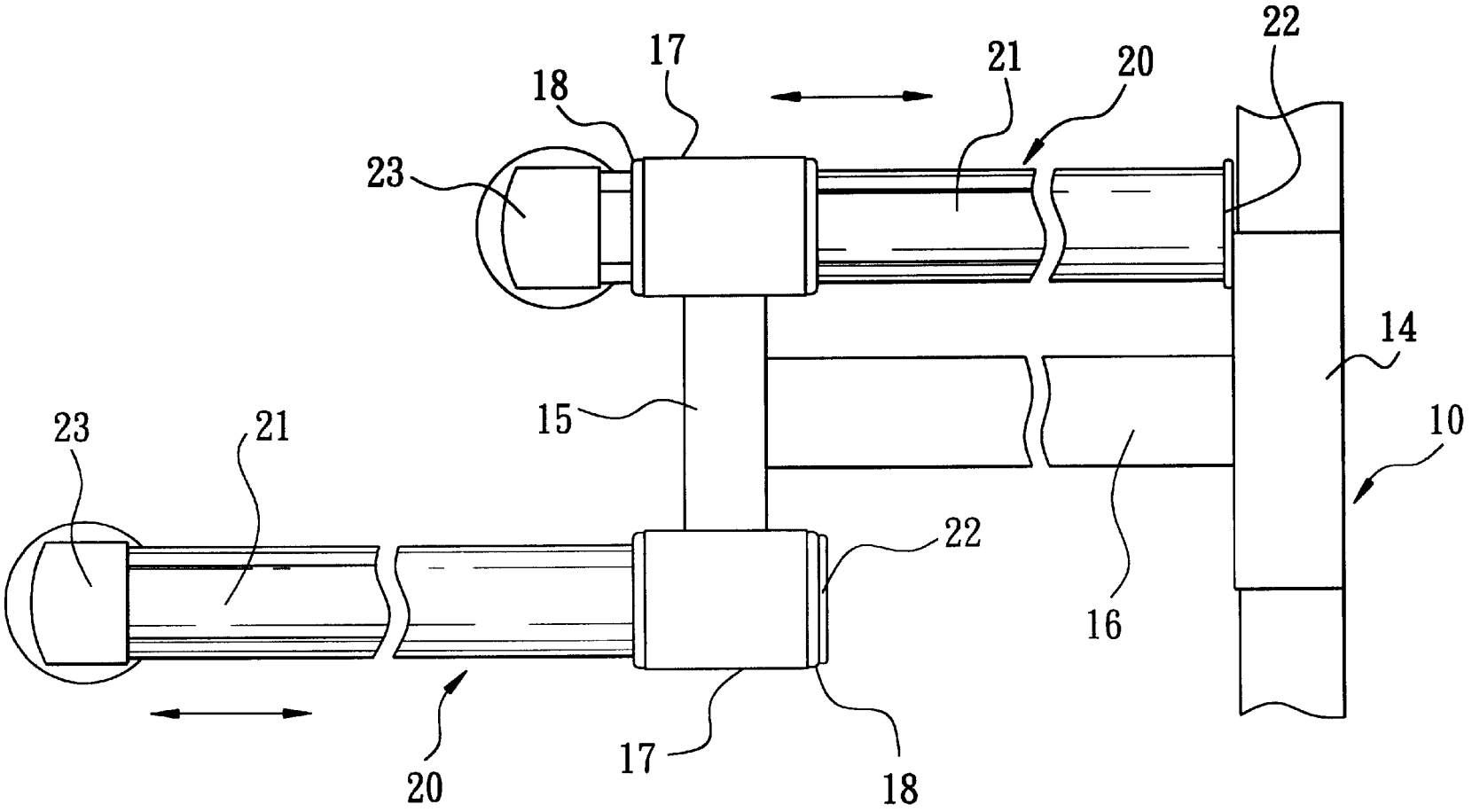
FIG. 6 is a schematic top view illustrating one of the rail members in a retracted position and the other one of the rail members in an extended position.

Referring to FIGS. 2, 3 and 6, the base member 10 is I-shaped and has a main shaft 16, front and rear bars 14, 15 connected transversely to two ends of the main shaft 16, a transmission wheel 11 mounted rotatably on the main shaft 16, and a resistance device 12 associated with the transmission wheel 11 for providing resistance against rotation of the transmission wheel 11 in a conventional manner. Each of two opposed ends of the rear bar 15 is formed with a ring member 17 having a rubber lining 18 which surrounds and which engages slidably a respective one of the rail members 20.

Each of the rail members 20 has a concave top face 21, and enlarged front and rear ends 22, 23. The enlarged front and rear ends 22, 23 prevent the rail members 20 from disengaging from the ring members 17 of the rear bar 15. Each of the rail members 20 is disposed perpendicularly to the rear bar 15 on either side of the main shaft 16 of the base member 10. The rail members 20 are movable between a retracted position in which the front ends 22 of the rail members 20 are proximate to the front bar 14 while the rear ends 23 of the rail members are proximate to the rear bar 15, as best illustrated in the upper part of FIG. 6, and an extended position in which the front ends 22 of the rail members 20 are proximate to the rear bar 15 while the rear ends 23 of the rail members 20 are distal from the rear bar 15, as best illustrated in the lower part of FIG. 6.

Figure 4:
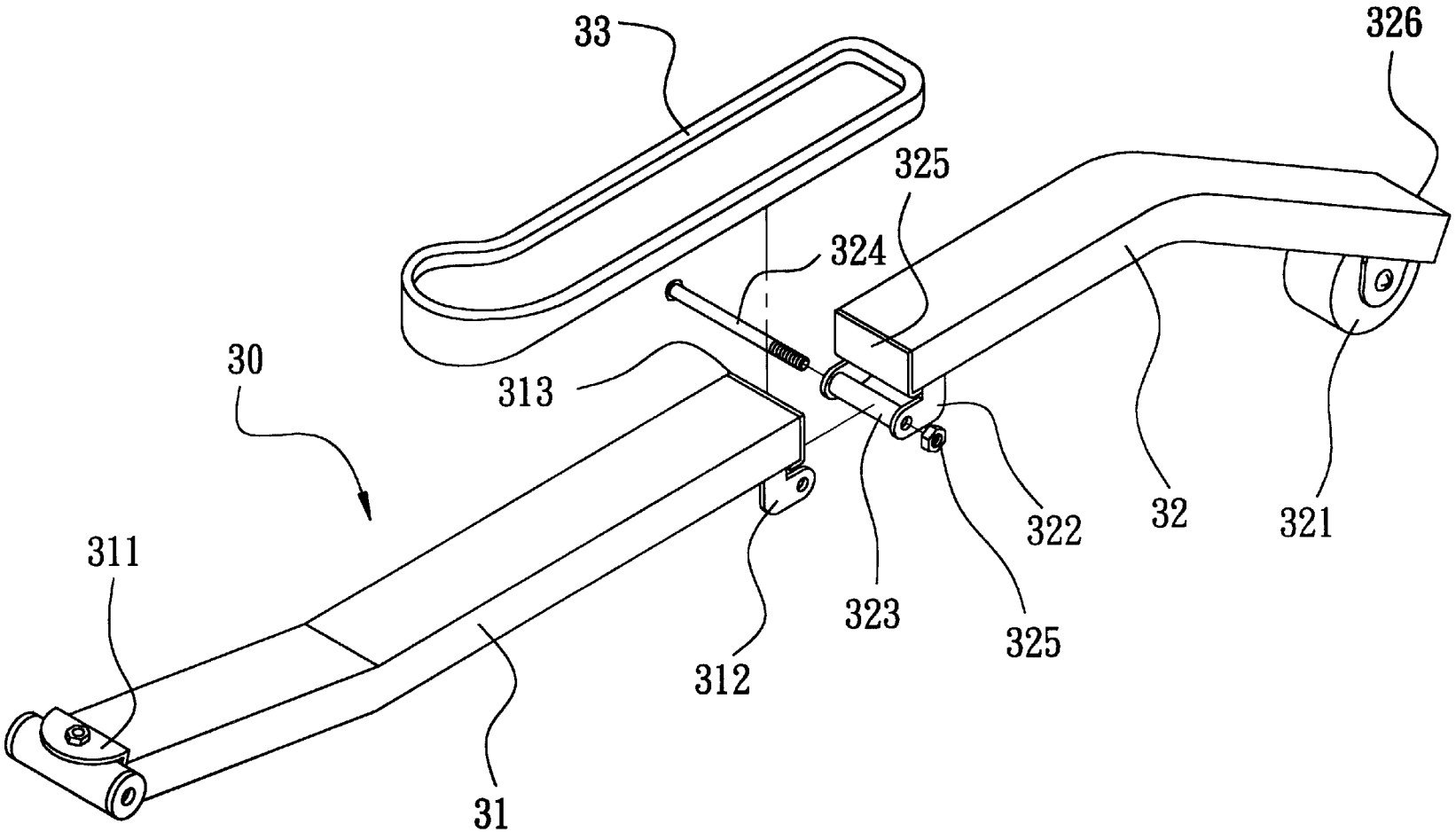
FIG. 4 is an exploded view of a pedal rod of the preferred embodiment of the foldable exerciser according to the present invention.
Figure 9:
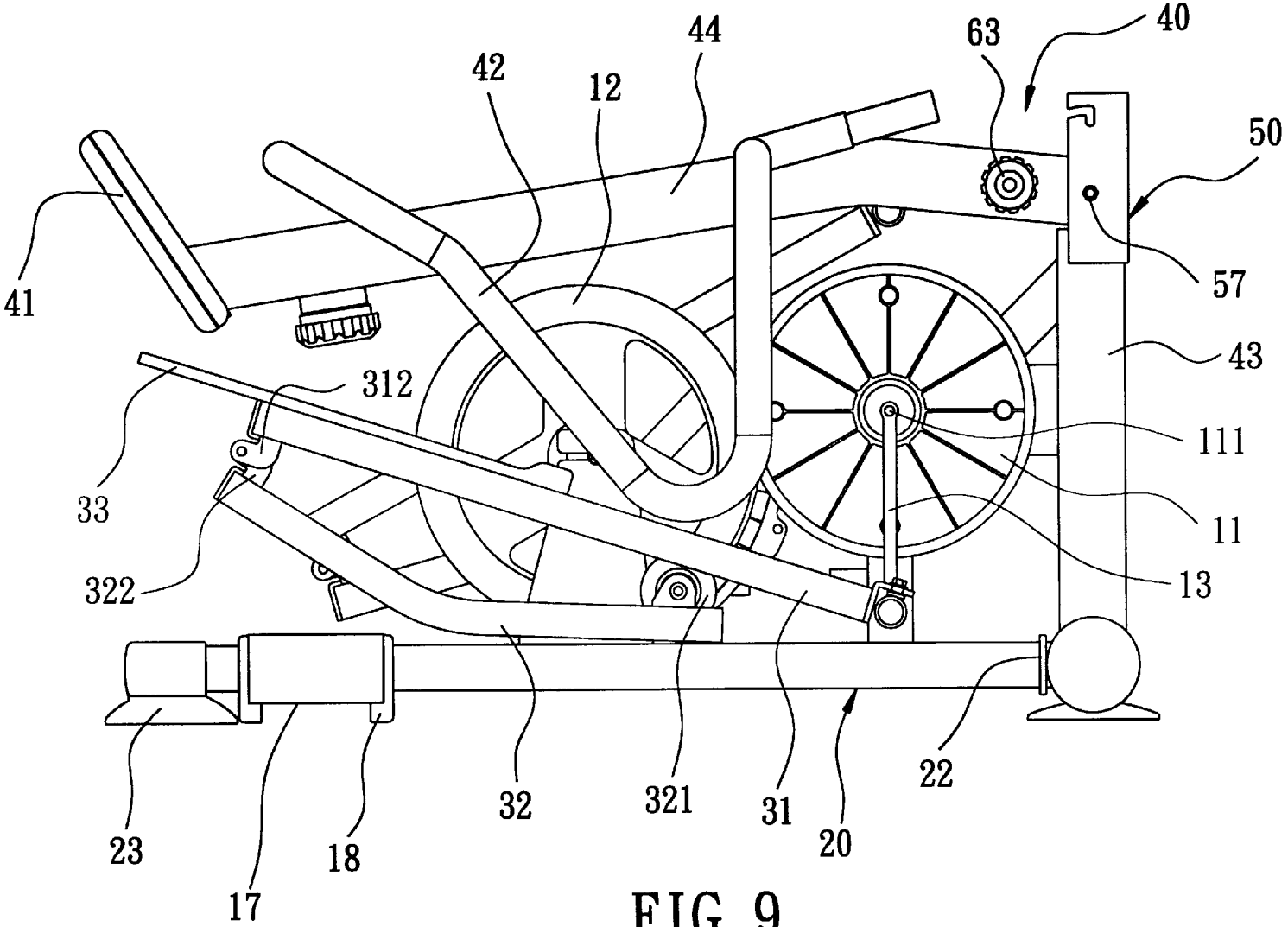
FIG. 9 is a schematic side view of the preferred embodiment of the foldable exerciser according to the present invention in a folded position.

Referring to FIGS. 4 and 9, each of the pedal rods 30 is disposed at either side of the base member 10 and has front and rear sections 31, 32, and an elongated stepping plate 33. The front section 31 of each of the pedal rods 30 has a front end 311, a rear end 313 that is formed with two engaging lugs 312 (only one is shown in the figures), and a crank arm 13 interconnecting the front end 311 thereof and the axle 111 of the transmission wheel 11. The rear section 32 of each of the pedal rods 30 has a front end 325 having a pair of pivot lugs 322 and a sleeve 323 interconnecting the pivot lugs 322, and a rear end 326 having a roller 321 connected thereto. A bolt 324 extends through the engaging lugs 312 on each of the front sections 31 and the sleeve 323 on each of the rear sections 32 and engages a nut 325 in order to interconnect pivotally the front sections 31 and the rear sections 32. As such, the rear sections 32 are foldable forwardly relative to the front sections 31 of the pedal rods 30. The rollers 321 are disposed on the concave top faces 21 of the rail members 20 when the rail members 20 are in the extended position. Each of the stepping plates 33 is fixed adjacent to the rear end 313 of a corresponding one of the front sections 31 and extends over the front end 325 of a corresponding one of the rear sections 32.

Figure 5:
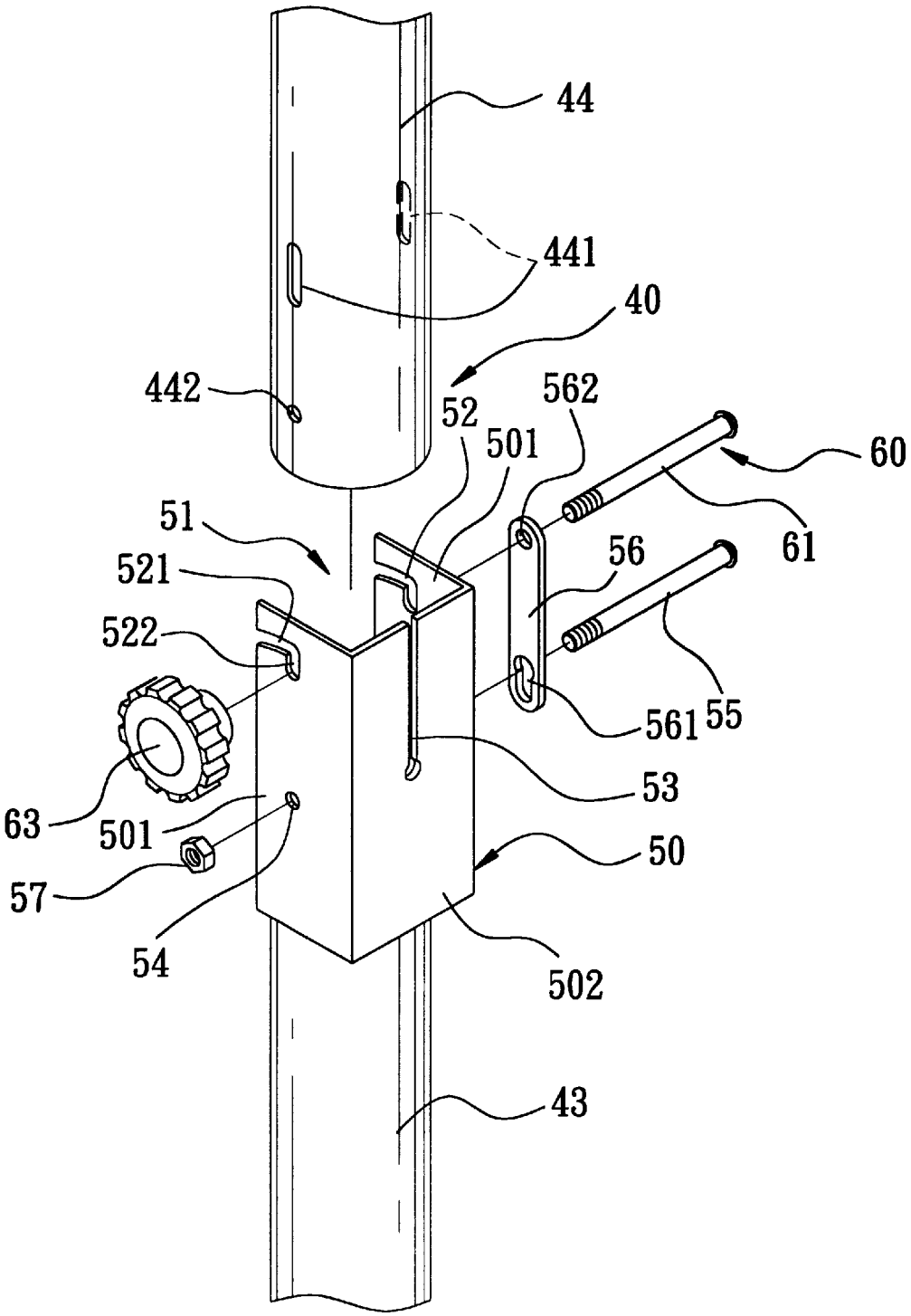
FIG. 5 is an exploded fragmentary view of an upright post of the preferred embodiment of the foldable exerciser according to the present invention.
Figure 7:
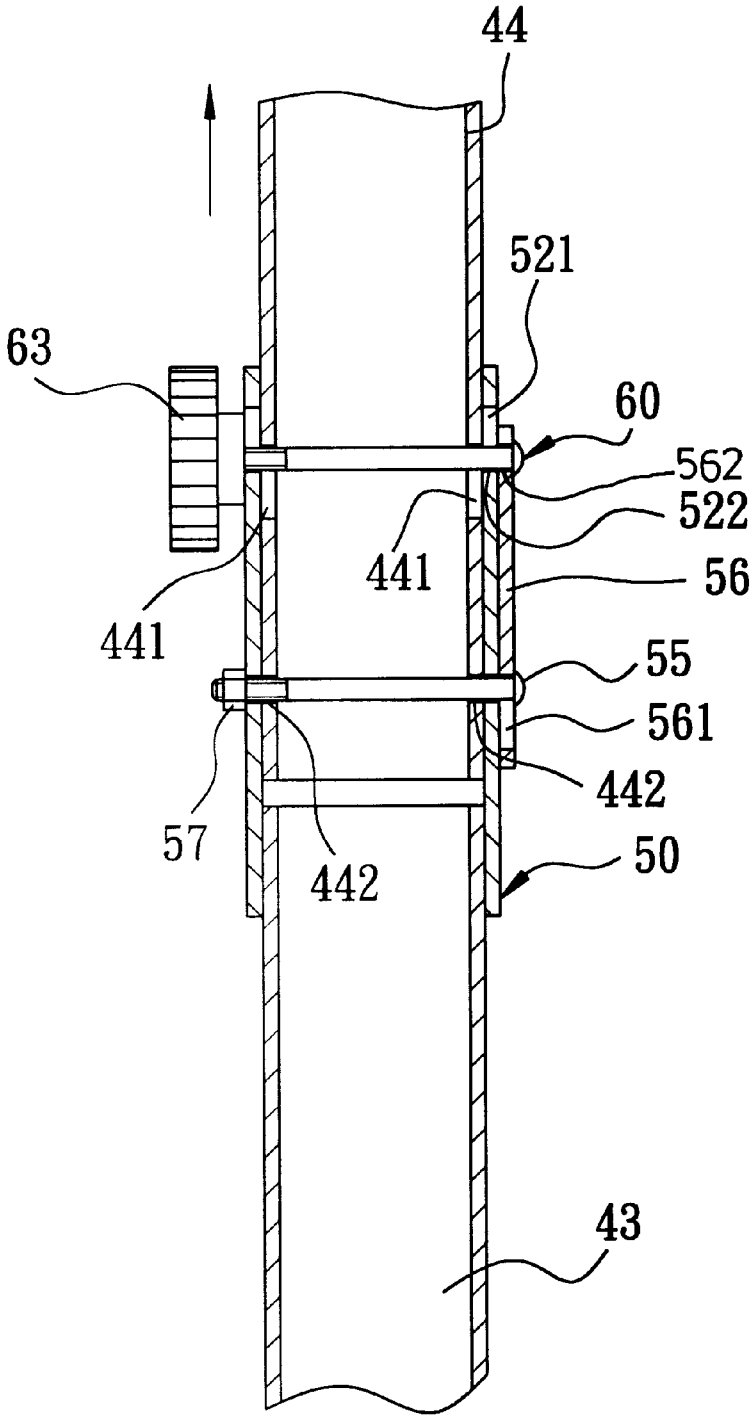
FIG. 7 is a fragmentary view of the upright post of the preferred embodiment according to the present invention.

Referring to FIGS. 2, 5 and 7, the upright post 40 is connected to the front bar 14 of the base member 10 and has a lower tube 43 extending upwardly from the front bar 14, and an upper tube 44 connected pivotally to the lower tube 43. The upper tube 43 has two aligned slots 441 and two aligned through holes 442 formed adjacent to a lower end thereof. The aligned slots 441 are elongated in the axial direction of the upper tube 43.

A U-shaped connecting piece 50 is fixed to an upper end of the lower tube 43 by a welding process. The connecting piece 50 has two opposed side walls 501, a base 502 interconnecting the opposed side walls 501, and a receiving space 51 defined by the opposed side walls 501 and the base 502. Each of the side walls 501 has an L-shaped notch 52 formed adjacent to an upper end thereof, and a through hole 54 formed in an intermediate portion thereof. The base 502 has an elongated notch 53 extending from an upper end toward a lower end thereof. An elongated coupling plate 56 is attached to one of the side walls 501 by means of a bolt 55. The bolt 55 extends through a keyhole-shaped slot 561 formed in a lower end of the coupling plate 56, the through holes 54 in the side walls 501, and the through holes 442 in the upper tube 44, and engages a nut 54. As such, the upper tube 44 is connected pivotally to the U-shaped connecting piece 50. In addition, the connecting plate 56 can turn about the bolt 55. Each of the L-shaped notches 52 is formed with a horizontal portion 521 and a vertical portion 522.

A locking device 60, e.g., a locking bolt, extends through an aperture 562 formed in an upper end of the coupling plate 56, the vertical portions 522 of the L-shaped notches 52, and the aligned slots 441 in the upper tube 44 and engages a nut member 63. As such, the upper tube 44 can be prevented from pivotal movement relative to the lower tube 43 when the upper tube 44 is located above the lower tube 43, as best illustrated in FIG. 2. A display panel 41 and a handle bar 42 are mounted on an upper end of the upper tube 44 in a conventional manner.

Figure 8:
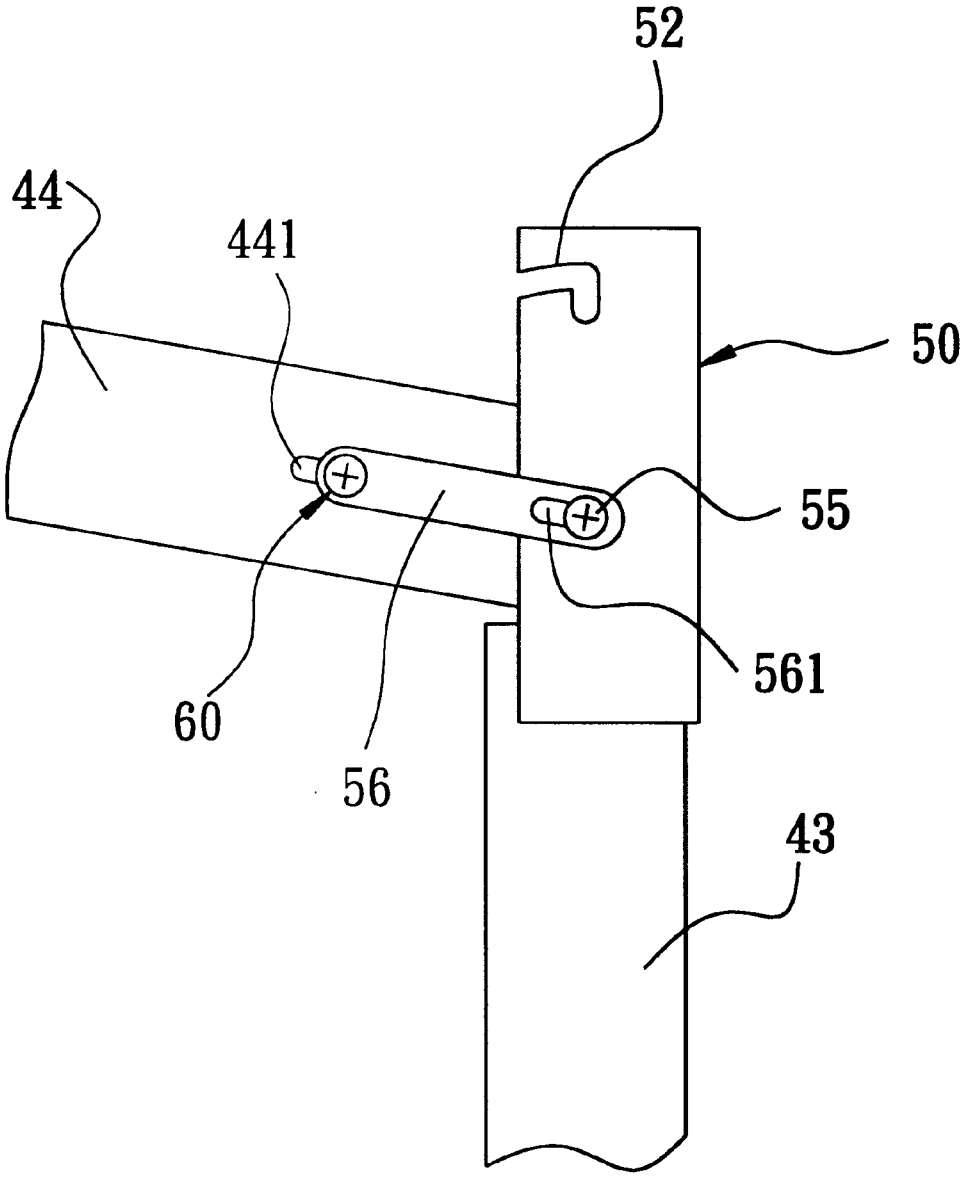
FIG. 8 is a schematic view illustrating how the upright post of the preferred embodiment is folded.

When it is desired to fold the exerciser, with reference to FIGS. 6 and 9, the rail members 20 are moved along the ring members 17 toward the front bar 14 to their retracted positions. The rear sections 32 are then turned downwardly about the bolt 324 to fold under the front sections 31. As such, the overall length of the base member 10 of the foldable exerciser can be dramatically reduced. Moreover, the nut member 63 is loosened to free the locking bolt 60 from the vertical portions 522. The upper tube 44 is then pulled upwardly to remove the locking bolt 60 from the vertical and horizontal portions 522, 521. As such, the upper tube 44 can be folded downwardly relative to the lower tube 43, as best illustrated in FIG. 8. In this way, the height of the upright post 40 can be greatly reduced. The object of the present invention is thus met.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A foldable exerciser, comprising:

an base member having a main shaft, front and rear bars connected transversely to two ends of said main shaft, a transmission wheel mounted rotatably on said main shaft, and a resistance device associated with said transmission wheel for providing resistance against rotation of said transmission wheel, said rear bar having two opposed ends;

an upright post connected to said front bar of said base member;

a pair of rail members connected slidably and respectively to said opposed ends of said rear bar, each of said rail members having front and rear ends and being disposed perpendicularly to said rear bar on either side of said main shaft of said base member, said rail members being movable between a retracted position in which said front ends of said rail members are proximate to said front bar while said rear ends of said rail members are proximate to said rear bar, and an extended position in which said front ends of said rail members are proximate to said rear bar while said rear ends of said rail members are distal from said rear bar; and a pair of pedal rods, each being disposed on either side of said main shaft of said base member and having front and rear sections, said front section of each of said pedal rods having a front end, a rear end, and a crank arm interconnecting said front end thereof and said transmission wheel, said rear section of each of said pedal rods having a front end connected pivotally to said rear end of said front section of a corresponding one of said pedal rods so that said rear sections of said pedal rods are foldable forwardly relative to said front sections of said pedal rods, and a rear end having a roller that is connected thereto and that is disposed on a corresponding one of said rail members when said rail members are in said extended position.

2. The foldable exerciser as claimed in claim 1, wherein each of said opposed ends of said rear bar has a ring member which surrounds and which engages slidably a respective one of said rail members.

3. The foldable exerciser as claimed in claim 1, wherein said upright post has a lower tube extending upwardly from said front bar, and an upper tube connected pivotally to said lower tube so that said upper tube is foldable relative to said lower tube.

4. The foldable exerciser as claimed in claim 3, wherein said lower tube has a U-shaped connecting piece fixed to an upper end thereof, said upper tube being connected pivotally to said U-shaped connecting piece.

5. The foldable exerciser as claim in claim 4, further comprising a locking device for preventing pivotal movement of said upper tube relative to said lower tube when said upper tube is located over said lower tube.

* * * * *